US007870851B2

(12) United States Patent
Mahany

(10) Patent No.: US 7,870,851 B2
(45) Date of Patent: Jan. 18, 2011

(54) DEVICE FOR OPTICALLY EXCITING AND DELIVERING LUMINESCENT PROJECTILES

(76) Inventor: Thomas E. Mahany, 3122 Warick Rd., Royal Oak, MI (US) 48073

( * ) Notice: Subject to any disclaimer, the term of this patent is extended or adjusted under 35 U.S.C. 154(b) by 0 days.

(21) Appl. No.: 12/046,830

(22) Filed: Mar. 12, 2008

(65) Prior Publication Data

US 2008/0223350 A1 Sep. 18, 2008

Related U.S. Application Data

(60) Provisional application No. 60/918,309, filed on Mar. 16, 2007.

(51) Int. Cl.
*F41B 11/28* (2006.01)

(52) U.S. Cl. ..... 124/56; 124/1

(58) Field of Classification Search ..... 124/56, 124/49, 51.1, 71–73
See application file for complete search history.

(56) References Cited

U.S. PATENT DOCUMENTS

| | | | | | |
|---|---|---|---|---|---|
| 2,508,461 | A * | 5/1950 | Lemon | 473/431 |
| 2,526,018 | A * | 10/1950 | Foster et al. | 124/73 |
| 3,905,349 | A * | 9/1975 | Nielsen et al. | 124/73 |
| 3,911,888 | A * | 10/1975 | Horvath | 124/56 |
| 4,207,857 | A * | 6/1980 | Balka, Jr. | 124/56 |
| 4,270,511 | A * | 6/1981 | Ehama | 124/81 |
| 4,291,665 | A * | 9/1981 | Bash et al. | 124/56 |
| 5,097,816 | A * | 3/1992 | Miller | 124/49 |
| 5,133,330 | A * | 7/1992 | Sharp | 124/56 |
| 5,228,427 | A * | 7/1993 | Gardner, Jr. | 124/71 |
| 5,251,906 | A * | 10/1993 | Heller et al. | 273/397 |
| 5,257,615 | A * | 11/1993 | Jones | 124/56 |
| 5,415,151 | A * | 5/1995 | Fusi et al. | 124/56 |
| 5,507,271 | A * | 4/1996 | Actor | 124/56 |
| 5,887,578 | A * | 3/1999 | Backeris et al. | 124/49 |
| 6,048,280 | A * | 4/2000 | Palmer et al. | 473/416 |
| 6,082,349 | A * | 7/2000 | Cheng et al. | 124/56 |
| 6,276,353 | B1 * | 8/2001 | Briggs et al. | 124/71 |
| 7,004,813 | B2 * | 2/2006 | Zuloff | 446/175 |
| 7,040,308 | B2 * | 5/2006 | Ciesiun | 124/47 |
| 7,278,417 | B2 * | 10/2007 | Ciesiun | 124/82 |
| 7,426,927 | B1 * | 9/2008 | Broersma | 124/49 |
| 2005/0115548 | A1 * | 6/2005 | Wilson | 124/56 |

* cited by examiner

*Primary Examiner*—Bret Hayes
*Assistant Examiner*—Reginald Tillman, Jr.

(57) ABSTRACT

A theatrical device for optically exciting and delivering objects coated with luminescent material has an enclosure with an inner reflective surface with a hollow transparent excitation passageway extending therethrough. A light source illuminates the objects in the passageway for exciting the luminescent material so that the objects glow brightly. A blower moves the objects through the passageway to an outlet where the glowing objects are projected into an audience for dramatic effect.

15 Claims, 7 Drawing Sheets

DEVICE FOR OPTICALLY EXCITING AND DELIVERING LUMINESCENT PROJECTILES

RELATED APPLICATION

This application is related to Provisional Application No. 60/918,309, filed Mar. 16, 2007, the teachings of which are incorporated herein by reference.

FIELD OF INVENTION

The present invention relates to a theatrical device, more particularly to a device for optically exciting the luminescent projectiles before shooting them on to a theatrical stage or towards the darkened audience space such as a darkened sports arena or concert venue.

BACKGROUND

Recreational projecting/launching devices are well-known in the art. Depending upon the target of interest, the projectile may be hollow or solid and launched at various velocities. Such devices typically include mechanisms for storing projectiles, automatically feeding the projectiles, and for launching the projectiles at various predetermined rates.

Such devices are used for various entertainment purposes including tennis, golf, baseball or the like. They can also be used for adding effect to theatre performances such as rock concert or the like. These devices provide a safe and reusable supply of projectiles for use in numerous games such as war games.

For instance U.S. Pat. No. 6,644,294 discloses a recreational projectile launching devices, and more particularly to an improved air cannon for launching large projectiles such as golf balls, paint balls, and the like.

Examples of recreational projectile launching devices include a T-Shirt Gattling Gun and the so called BallBlaster employed in sports venues by a company called FX In-Motion. The T-shirt gattling gun shoots cylinders which have T-shirts inside them towards the audience. Similarly the BallBlaster fires plastic balls into the air and then lofts them into the crowd. With the simple pull of one lever, one can have control over the amount of balls that is shot out.

One of the disadvantages of the products and devices mentioned is that when the cylinders or the plastic balls are shot towards the audience, the low light conditions reduce visibility, and the visual effects of the activity are less effective and dramatic.

While the foregoing described prior art devices have entertainment value, there remains a need for entertainment devices which produce more dramatic special effects.

SUMMARY OF INVENTION

The invention is based on the discovery that luminescent projectiles may be projected into dimly lit audience areas of sports and concert venues with high visibility for enhanced entertainment value. In this connection the invention employs an apparatus for optically exciting projectiles so that they become luminescent and visible in low light conditions, and projecting the luminescent projectiles into the audience area.

Among the objects of the present invention is to provide a device which optically excites and projects relatively light objects or projectiles, e.g. ping pong balls or the like, which are integrally formed with a luminescent material therein or which have a luminescent coating.

In an exemplary embodiment, the invention comprises an apparatus for optically exciting and projecting luminescent projectiles into a dimly lit audience area. The apparatus has an enclosure having an inlet and an outlet with a hollow transparent excitation passageway extending between the inlet and the outlet for carrying the projectiles there through. An illumination device is located in the enclosure proximate to the hollow transparent excitation passageway for illuminating the projectiles in the passageway so that they become optically excited and luminescent. A blower, in flow communication with the passageway, pressurizes the passageway to move the projectiles therethrough as they become optically excited and to forcibly project the projectiles from the outlet into the audience area while they are luminescent and therefore highly visible under low light conditions.

The projectiles are subjected to excitation energy and become luminescent for a period of time. Thereafter, the objects are ballistically projected or shot onto a theatrical stage or into the darkened audience space so that they present a pleasing display of flying luminescent objects. The objects may be caught by audience members and saved as a souvenir of the event. The objects may also have printing or advertising material thereon identifying the artist or the like. An arrangement has been provided which can simultaneously excite the luminescent projectiles and shoot them towards the audience.

Various embodiments include a chamber having an excitation passageway that passes straight through the interior of the device proximate the light source. Another embodiment employs a spiral excitation passageway surrounding the light source. In another embodiment the excitation passageway is in the form of an annular channel surrounding the light source. In yet another embodiment, the projectiles are agitated in a holding area where they are illuminated prior to discharge from the device.

The operation of the invention will be understood and its several advantages appreciated from the detailed description which follows in connection with the accompanying drawings illustrating the various embodiments of the device.

DETAILED DESCRIPTION OF THE PREFERRED EMBODIMENT

Figure 1:
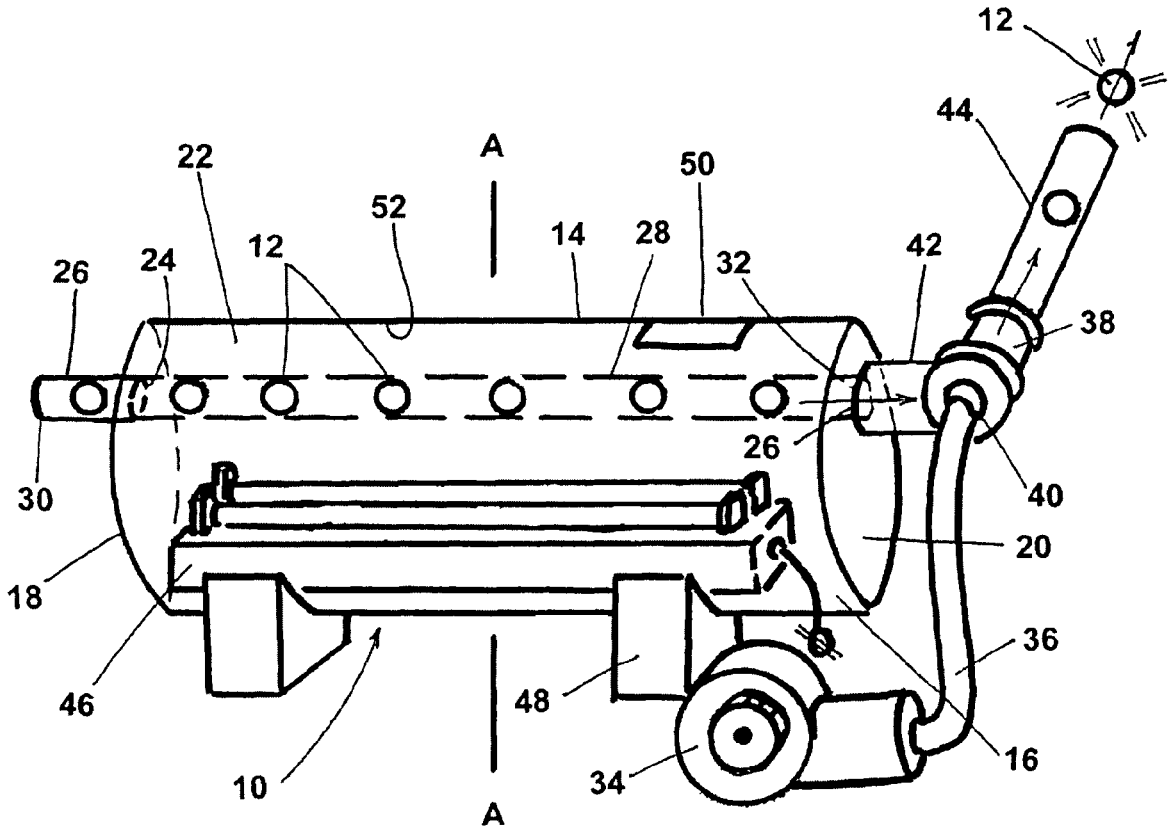
FIG. 1 is a fragmentary schematic side view of an exemplary embodiment of the invention employing a pressurized transparent passageway for carrying projectiles therethrough proximate to a source of illumination or light enclosed within a cylindrical enclosure.
Figure 2:
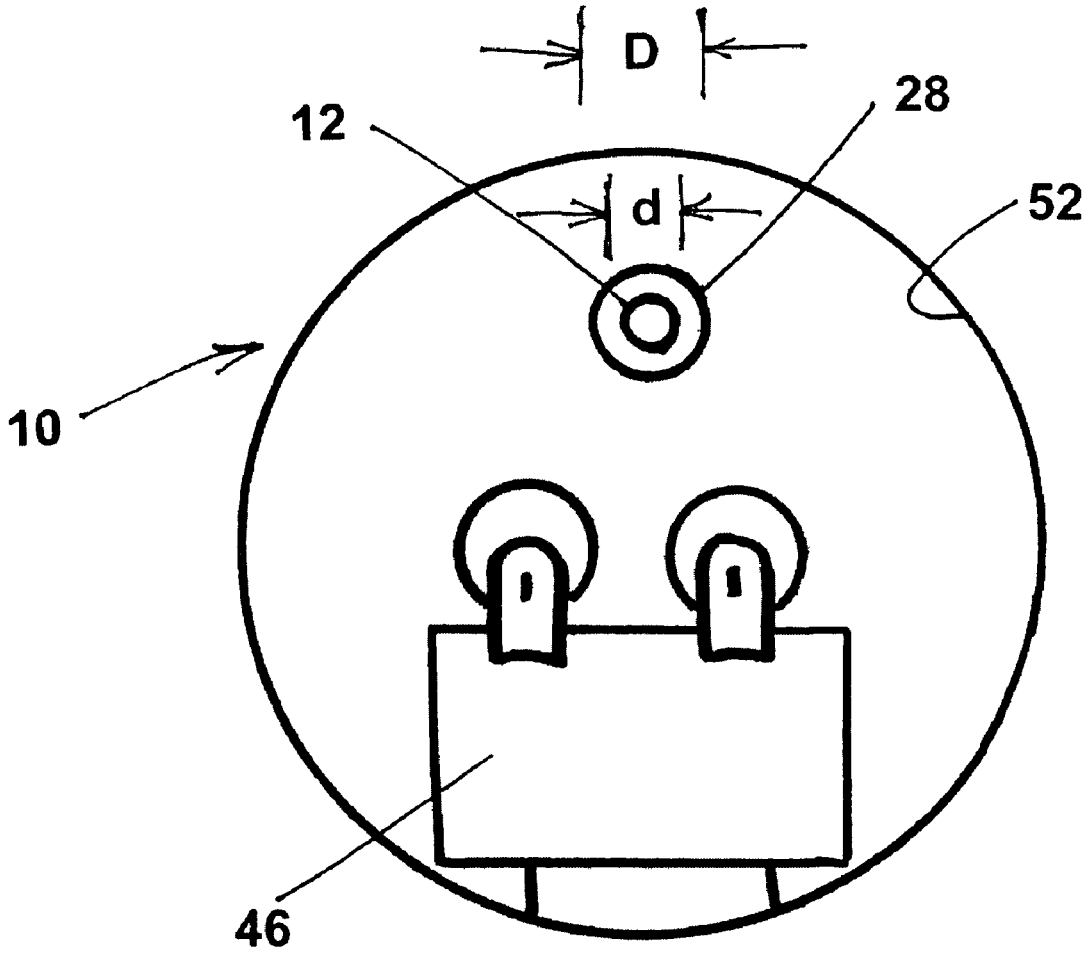
FIG. 2 is a cross-sectional view of arrangement of FIG. 1.

FIGS. 1 and 2 illustrate, in schematic form, an exemplary embodiment of a device 10 for optically exciting and projecting luminescent objects or projectiles 12. The device 10 comprises an enclosure 14 in the form of a body having a light opaque outer cylindrical sidewall 16 and end walls 18, 20 forming a hollow interior chamber 22. The enclosure 14 has an inlet opening 24 formed in the end wall 18 and an outlet opening 26 formed in the second end wall 18. An excitation passageway 28 in the form of a hollow transparent plastic tube has an inlet 30 and an outlet 32. The tube 28 is located in the enclosure extending between the inlet opening 24 to the outlet opening 26 as shown. The excitation passageway 28 is formed of a material transparent to light of a selected wavelength.

The projectiles 12 in the form of balls are fed into the inlet 30 of the tube 28. The projectiles 12 may be formed of a plastic or resin material having a concentrated luminescent color blended therein or it may be painted or coated with luminescent paint. When excited by light of the selected wavelength, the luminescent material becomes optically excited and glows brightly.

A compressor or blower 34 is coupled to the outlet 32 of the tube 28 by a connector pipe 36 and 'T' fitting 38 having an inlet 40 connected to the pipe 36 for air; an inlet 42 connected to the outlet 32 of the tube 28 for receiving projectiles; and an elongated muzzle outlet or nozzle 44 for discharging projectiles 12.

The blower 34 forces air through the pipe 36 and T fitting 38 which may employ a venturi effect nozzle (discussed hereinafter in greater detail with respect to FIG. 6.) to the elongated muzzle outlet or nozzle 44. The forced air causes the projectiles 12 to be sucked through the excitation passageway 28 into the T fitting inlet 42, where the projectiles 12 are forced by the air from the blower into the muzzle outlet 44 for projection into the local exterior space.

The enclosure 14 has a light source 46 located in the hollow interior chamber 22 in proximity to the excitation passageway 28. The light source 46 produces light is of a wavelength which is tuned to the excitation energy of the luminescent material as noted above, whereby said material is caused to glow brightly. In other words, as the projectiles 12 are drawn through the excitation passageway 28 the light passes through the tube and impinges on the projectiles 12 so that they become excited by the light source 46 and glow brightly, whereupon they are thereafter quickly projected from the elongated muzzle or nozzle 44 and into the audience.

The enclosure 14 may be supported by legs or feet 48 as shown with its central axis A disposed in the horizontal direction. It should be understood that the enclosure 14 may take various forms and may be disposed in a variety of orientations as hereinafter discussed.

The enclosure 14 may be a closed cylindrical structure having an access port or door 50 formed in either or both end walls or the cylindrical outer wall as required. In order to enhance and maximize the light produced from the source 46, inner walls 52 of the enclosure 14 may be coated with a highly reflective coating or paint which reflects the light towards the excitation passage 28. The light source 46 may be high intensity visible light, so-called black light, or both that has a high ultra-violet component, or any suitable source capable of exciting the luminescent material on or in the projectiles 22. The enclosure is light opaque so that it contains the light and is not illuminated during a production and is thus not visible to the audience.

As illustrated in FIG. 2, the excitation passageway 28, (and the T fitting 40 and the muzzle 44 as well) each have a minimum inner diameter D; and the projectiles 12 have a maximum outer diameter d. The maximum diameter d of the projectiles 12 is sized just slightly smaller than the inner diameter D so that they can fit and easily pass through the excitation passageway, the T fitting and the outlet muzzle or nozzle when the blower in on without undue loss of forced air pressure or flow.

Figure 3:
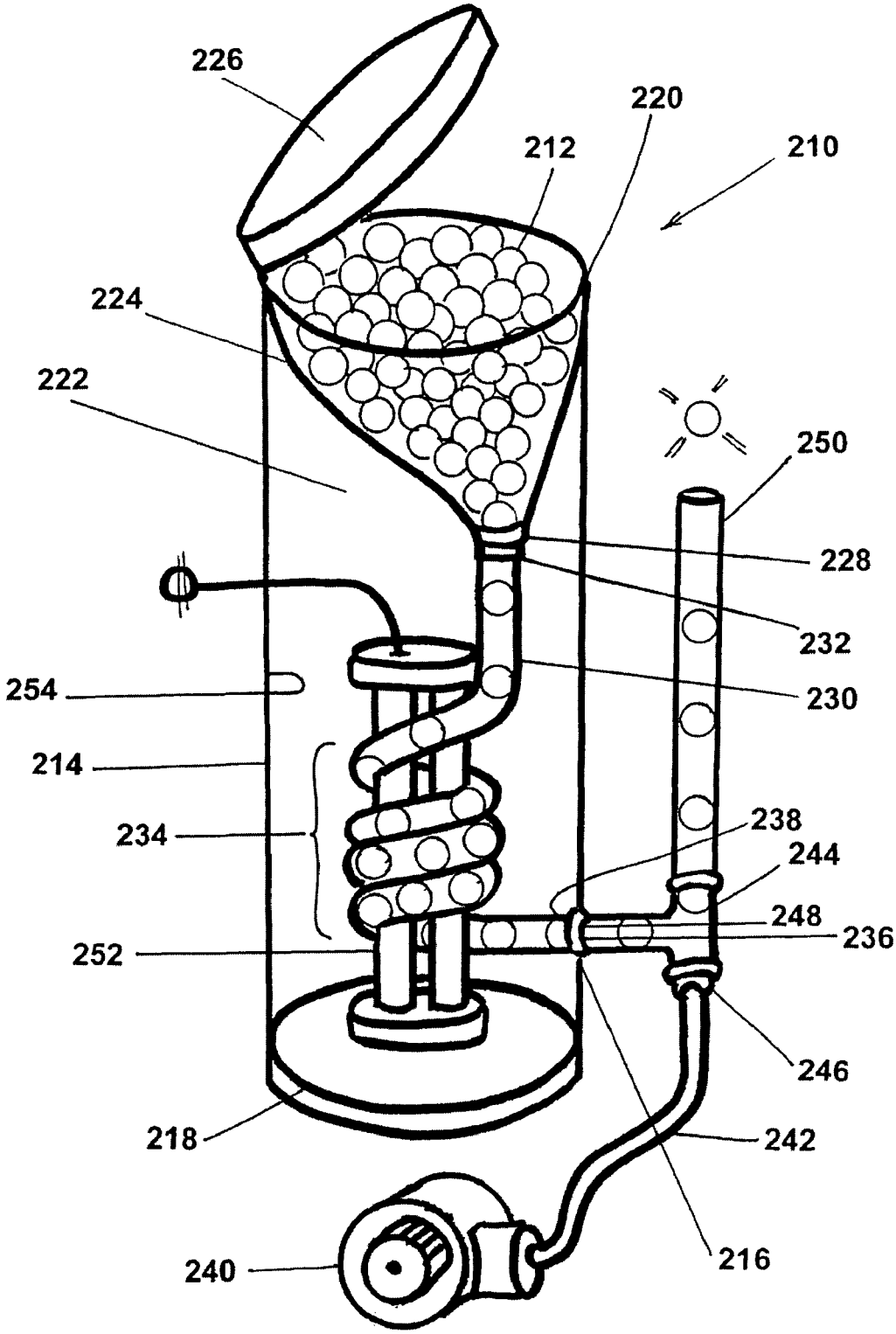
FIG. 3 is a fragmentary schematic side view of another embodiment of the present invention employing a spiral transparent passageway surrounding the light within the enclosure.

FIG. 3 shows is a schematic side view of another embodiment of the invention employing a device 210 for optically exciting and projecting luminescent objects or projectiles 212 into an audience. The device 210 comprises an enclosure 214 in the form of a light opaque body 214 having a cylindrical sidewall 216, a base 218 and an open top 220 forming a hollow interior chamber 222. The enclosure 214 has a hopper 224 located in the open top 220 for receiving unexcited projectiles 212 therein. The hopper 224 has a lid 226 and a hopper outlet 228 for unexcited projectiles 212. An excitation passageway 230, in the form a hollow transparent plastic tube transparent to light of a selected wavelength, has an inlet 232 connected to the hopper outlet 228, a helical section 234 connected to the inlet, and an outlet 236 for delivering excited projectiles 212. The cylindrical sidewall 216 of the enclosure 214 has an outlet opening 238 for the excitation passageway 230. The excitation passageway 230 is located in the enclosure 214 and extends between the hopper outlet 228 and the opening 238.

The unexcited projectiles 212, in the form of balls, are fed in to the hopper 224. The projectiles 212 are similar to those described above. They may be formed of a plastic or resin material having a concentrated luminescent coloring material mixed in or they may be coated with a luminescent paint. The projectiles 212 exhibit similar luminescent characteristics when optically excited as discussed above.

A compressor or blower 240 is coupled to the outlet 236 of the excitation passageway 230 by a connector pipe 242 and T-fitting 244 with a venturi effect nozzle (discussed hereinafter). The T fitting has an air inlet 246 connected to the connector pipe 242 for receiving air from the blower 240; a projectile inlet 248 connected to the outlet 236 of the tube for receiving optically excited projectiles 212; and a muzzle outlet 250 for projecting optically excited projectiles into the audience.

The blower 240 forces air through the pipe 242 and T fitting 244 to the muzzle outlet 250. The forced air causes the projectiles 212 to be sucked through the transparent excitation passageway 230, where they are optically excited, and into the T fitting inlet 248, where the projectiles 212 are forced by the air from the blower into the elongated muzzle outlet 250 for projection into the local exterior space.

The enclosure 214 has a light source 252 of the selected wavelength tuned to the excitation energy of the luminescent material in or on the projectiles. The light source is located at the center of the hollow interior chamber 222. The excitation passageway has a helical section 234 which surrounds the light source. The light source 252 produces light tuned to the excitation energy of the luminescent material, which passes through the passageway and impinging on the projectiles, which absorb the light and become optically excited, whereby the luminescent material is caused to glow brightly. The helical section 234 of the passageway allows the projectiles to follow an elongated path around the light source so that they become fully exposed to the light so that they become strongly excited and thereby glow brightly and with increased duration. In other words, as the projectiles are drawn through the helical section 234 of the excitation passageway 230 they dwell within the passageway for a time sufficient to result in increased luminescence. Thereafter the projectiles 212 are quickly projected from the muzzle outlet 250 and into the audience.

It should be understood as discussed hereinafter enclosure 214 may take various forms and may be disposed in a variety of orientations.

In order to enhance and maximize the light produced from the source 252, inner surface 254 of the enclosure 214 may be coated with a highly reflective coating or paint which reflects the light towards the excitation passage 230. The light source 252 may be high intensity visible light, so-called black light that has a high ultra-violet component, or any suitable source capable of exciting the luminescent material on or in the projectiles 212.

The helical section 234 of the excitation passageway may be a relatively tight helix spaced from the interior walls of the chamber, as shown. Alternatively, the helical section may have a larger diameter and be disposed in close proximity or in contact with the interior walls of the chamber thereby forming a longer path and longer dwell time for excitation.

Figure 4:
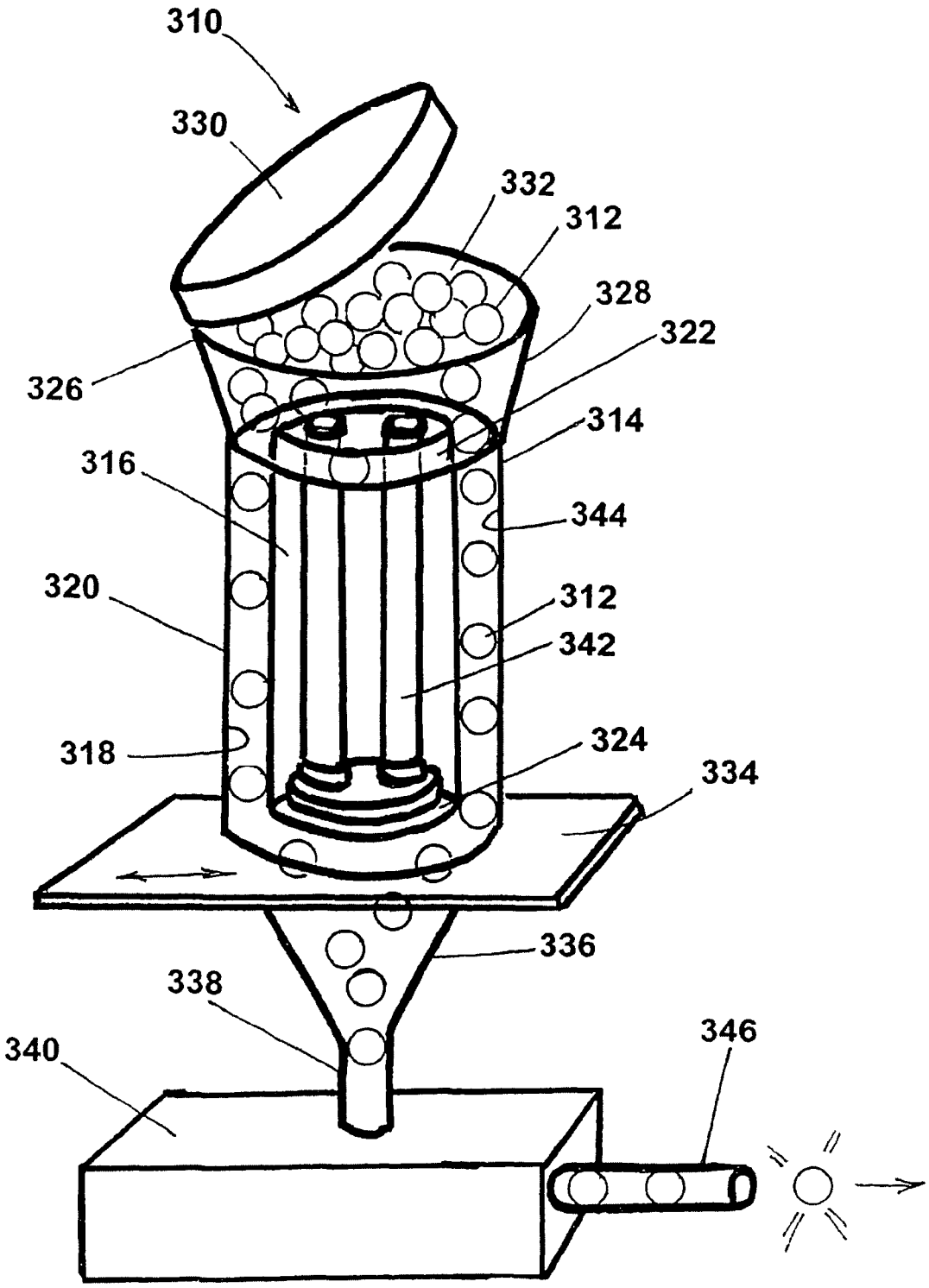
FIG. 4 is a fragmentary schematic side view of another embodiment of the present invention employing an annular channel for carrying projectiles therethrough and having a transparent inner wall surrounding the light.

FIG. 4 shows a schematic side view of another embodiment of a device 310 for optically exciting and projecting luminescent objects or projectiles 312. The device 310 comprises an optically opaque enclosure 314 having a hollow interior chamber 316, an optically transparent inner side wall 318 and an optically opaque outer side wall 320, forming an annular excitation passageway 322 about the inner periphery of the enclosure 314. The enclosure 314 has a base 324, an open top 326 and a hopper shaped storage area 328 near the top 326. A lid 330 covers the open top. The storage area has an annular opening 332 feeding the annular excitation passageway 330. The lower end of the passageway feeds outlet opening 334 into a funnel shaped chamber 336 having an outlet 338.

The projectiles 312 in the form of balls are fed in to the hopper shaped top 328 and pass through the annular excitation passageway 330 where they are optically excited and to the outlet 338 which feeds a projector 340 having an elongated muzzle outlet or outlet nozzle 342.

The projector 340 may be a blower or fan which sucks the projectiles through the device and projects them into the audience area through the elongated outlet or muzzle 342

The enclosure 314 has a light source 344 located within the hollow interior chamber 316 proximate to the annular excitation passageway 322. The light source 342 produces light of a selected wavelength which passes through the inner wall 318 of the excitation passageway and which is absorbed by the luminescent material in or on the projectiles, thereby optically exciting the projectiles so that they glow brightly, in a manner similar to the previous description.

It should be understood as discussed above that the enclosure 314 may take various forms and may be disposed in a variety of orientations.

In order to enhance and maximize the light produced from the source 342, inner surface 344 of the outer side wall 320 may be coated with a highly reflective coating or paint which reflects the light towards the annular excitation passage 322. The light source 342 may be high intensity visible light, so-called black light that has a high ultra-violet component, or any suitable source capable of exciting the luminescent material on or in the projectiles 312.

Figure 5:
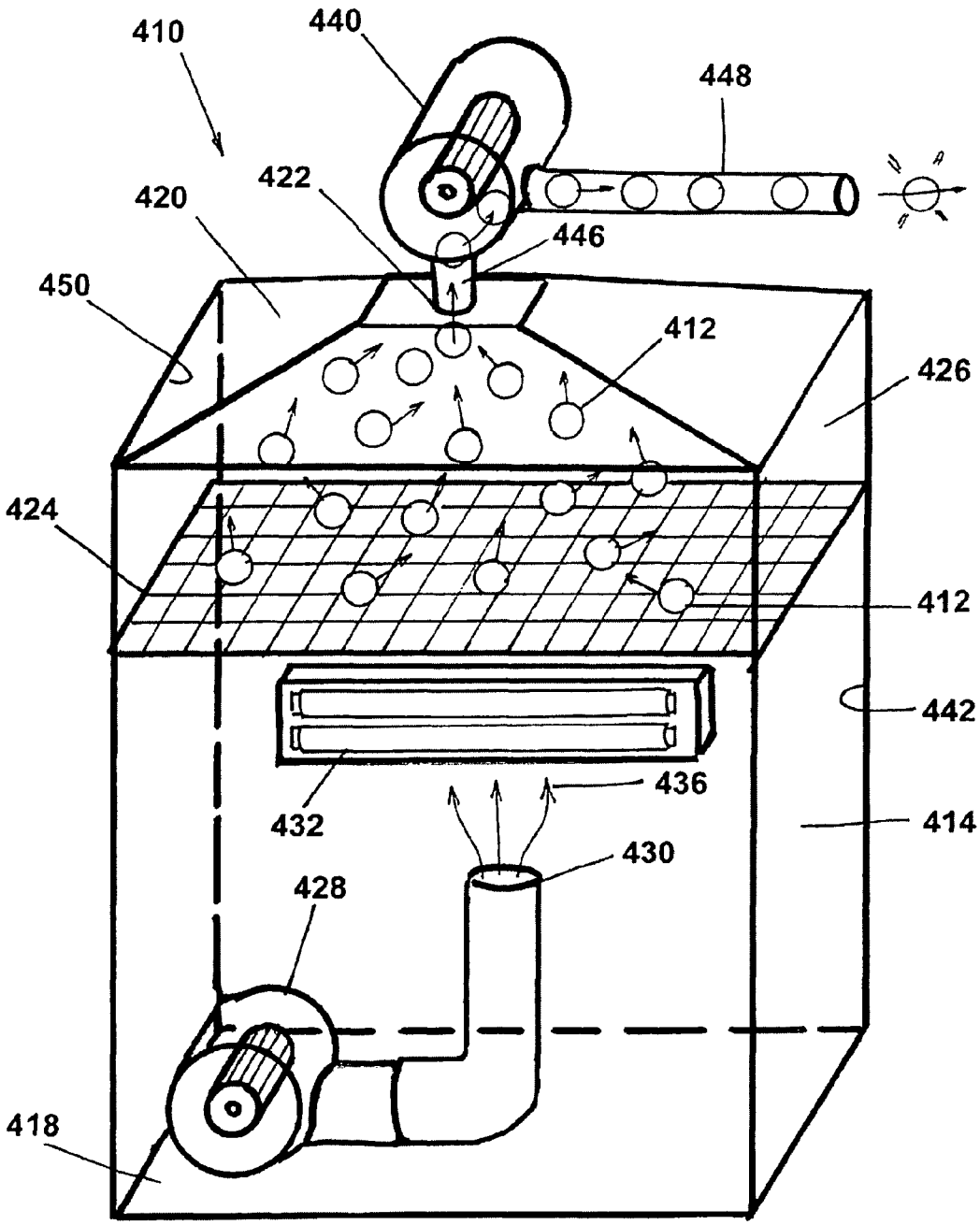
FIG. 5 is a fragmentary schematic side view of another embodiment of the present invention employing a blower for freely agitating the projectiles within an illumination chamber.

FIG. 5 is a schematic side view of another embodiment of the device 410 for optically exciting and projecting luminescent objects or projectiles 412. The device 410 comprises an enclosure 414 in the form of an upright box like structure having sidewalls 416, a base 418. A lid 420 with an outlet 422 therein. The enclosure 414 further includes an excitation screen 424 in the form of a mesh disposed in spaced relation with and below the lid 420 forming an excitation and agitation region 426 to receive and hold a supply of projectiles 412 therein.

The projectiles 412 in the form of balls are placed in the excitation and agitation region 426 above the screen 424. The projectiles 412 are of similar characteristics as used in the earlier embodiment.

A blower 428 with an air outlet 430 is removably attached to the base 418 of the enclosure 414. A relatively high volume of air 436 (shown by arrows) flows from the blower 428 into the region 426 through the air outlet 430. The high volume of air 430 agitates the projectiles 412 in the region and they bounce around therein above the screen 424.

The enclosure 414 has a light source 432 located in or adjacent to the region 426 proximate to the screen 424. The light source 432 functions in a similar manner as described in the other embodiments of the invention, producing light of a selected wavelength suitable for optically exciting the luminescent material in or on the projectiles to cause them to glow brightly.

It should be understood as discussed above that the enclosure 314 may take various forms and may be disposed in a variety of orientations as long as the transport and agitation of projectiles is facilitated.

A suction pump 440 with an inlet 442 is coupled to the outlet 422 of the lid 420 the help of a connector pipe 438. The suction pump 446 further has an elongagated muzzle outlet 448 for projection of the projectiles 412 in to the local exterior space.

The suction pump 440 draws in the agitated projectiles 412 lying in the region 426 above the screen 424 through the connector pipe 446 and projects them in to the local exterior space through the elongated muzzle outlet 448.

In order to enhance and maximize the light produced from the source 432, the inner surface 450 of the outer side wall 416 may be coated with a highly reflective coating or paint which reflects the light towards the excitation region 426. The light source 432 may be high intensity visible light, or so-called black light that has a high ultra-violet component, or both, or any suitable source capable of exciting the luminescent material on or in the projectiles 412.

Figure 6:
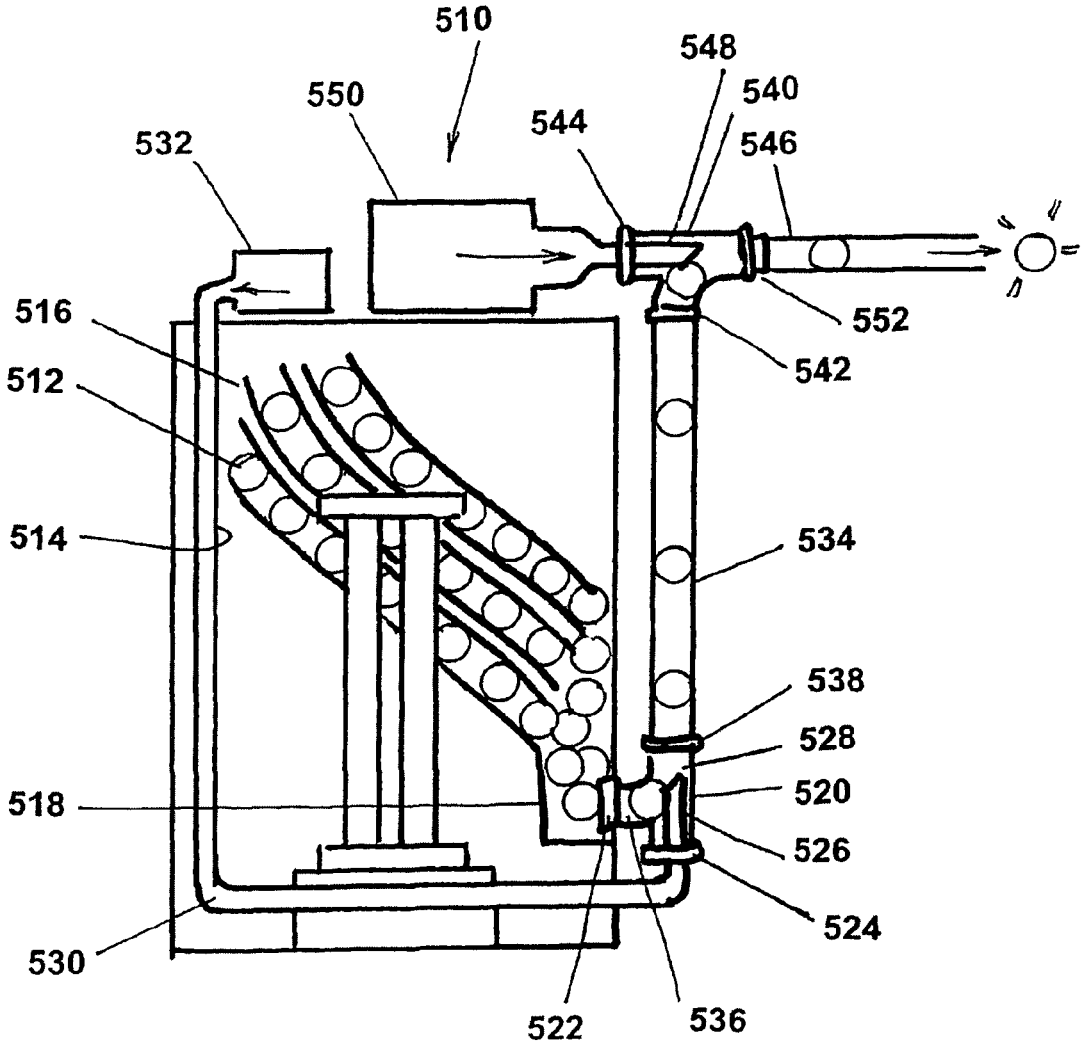
FIG. 6 is a fragmentary schematic illustration of another embodiment of the invention employing a venturi muzzle or nozzle.

FIG. 6 illustrates a schematic diagram of an exemplary embodiment of the device 510 according to the invention which employs a venturi effect injection nozzle system, herein after venturi. As noted above, a venturi system, described in more detail hereinafter, may be employed in any or all of the various embodiments for enhancing the projection efficiency and flow of projectiles 512 through the system. In particular, a venturi is useful for better enabling air flow to draw projectiles into junctions and project or push the projectiles in a desired manner along the various channels in the system.

As shown, the housing 514, which is similar to the arrangements discussed above has a feeder 516 for projectiles 512. The feeder 516 is coupled to a reservoir 518 coupled to an outlet fitting 520. The fitting 520 has a ball or projectile inlet 522 coupled to the reservoir 518; an air inlet 524; and a ball outlet 526. The air inlet 524 has a venturi effect injection nozzle or venturi 526 having an air outlet 528 located in the fitting 520 adjacent to the ball inlet 522 as shown. The venturi 526 is fed by an air pipe 530 connected to a blower 532. The venturi effect forces air into the fitting 520 adjacent the ball inlet 522 causing a suction to draw balls from the reservoir 515 into the fitting 520. The venturi 526 also pushes air into the ball outlet 526 to project the balls to outlet feed pipe 534. The fitting 520 may be a 'T' with a curved feed 536 for smoothing the transition for the balls into the ball outlet 526 and then through the outlet 526. According to the exemplary embodiment the fitting has a nominal inner diameter of about 2" and the venturi 526 has a nominal diameter of about 0.75".

The outlet feed pipe 534 is coupled to a muzzle venturi 540 having a ball inlet 542, an air inlet 544 and an elongated muzzle outlet 546. A venturi 548 is located in the air inlet 544 as shown. The arrangement is similar to the arrangement discussed above. The venturi 548 is coupled to a blower 550, and has an outlet 552 near the air ball inlet 542 as shown. The muzzle venturi 540 has a smooth transition between the ball inlet and air inlet, much like the arrangement discussed below. The air inlet has a diameter of about 2" and the venturi 548 has a diameter of about 1". The size of the various pipes may change as adjustments to air and ball movement are desired. Likewise the air flow in cfm of the blowers may be adjusted as well.

Figure 7:
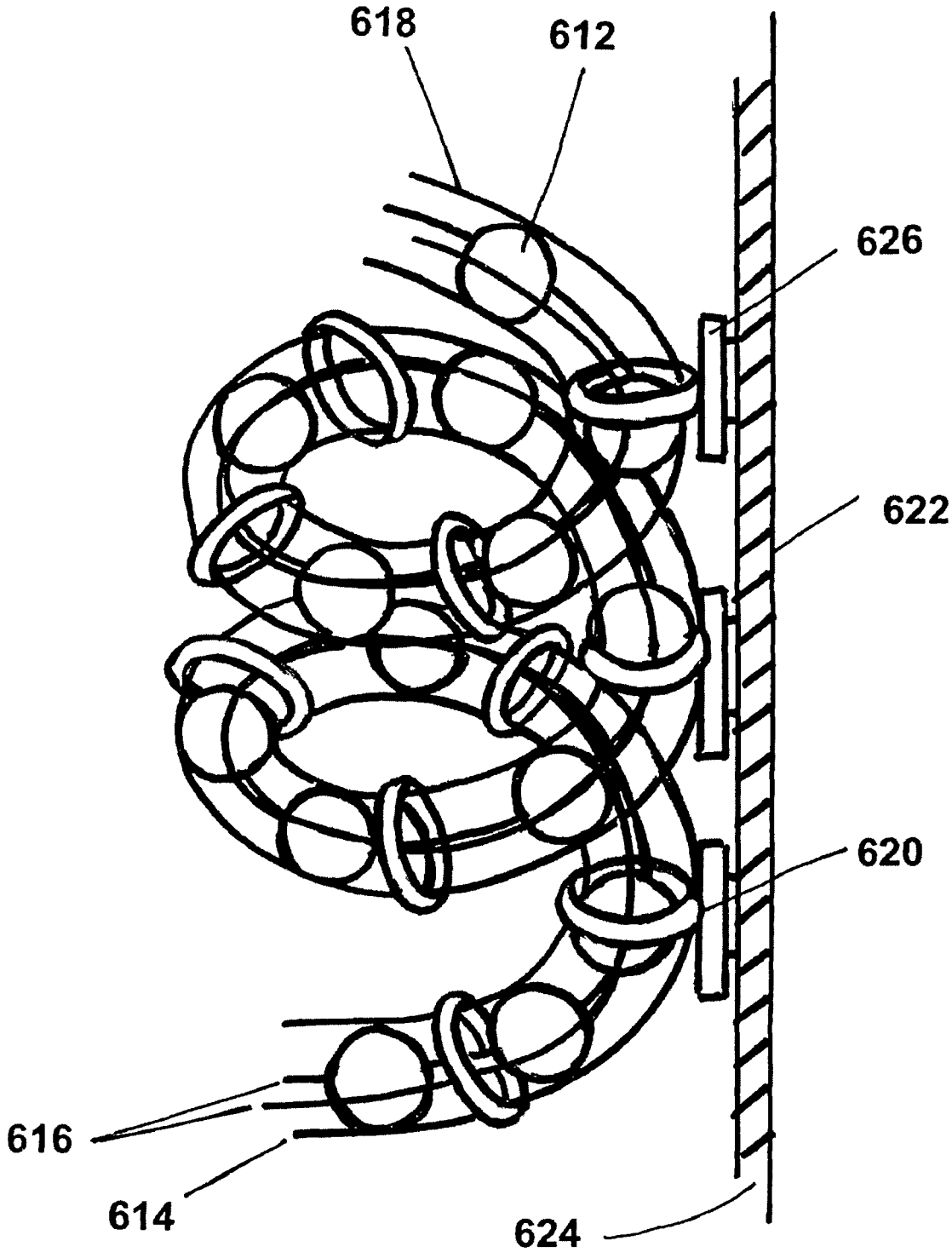
FIG. 7. is a fragmentary schematic illustration of a track for conveying projectiles through an excitation passageway.

FIG. 7 illustrates a feature of the invention for carrying projectiles through the housing. The arrangement is in the form of a track 610 for carrying projectiles 612. The track 610 comprises a lower rail 614, one or more side rails 616 and an upper rail 618 if desired resulting in a cage for confining the projectiles 612 as shown. The track 610 also includes one or more rings 620 secured along the track to the rails for maintaining the rails in position. The ring 620 may be secured to the wall 622 of the housing 624 by a bracket 626. The rails may be shaped to form a circular or helical exitation pathway in the housing for providing sufficient dwell time in the housing for exciting the luminescent material in or on the balls as hereinabove described.

I claim:

1. An apparatus for illuminating and propelling a plurality of optically excitable projectiles comprising:

an enclosure having an interior space and an inlet and an outlet;

a venturi comprising:

a first tubular pipe portion having a projectile inlet connected to the enclosure outlet for receiving projectiles, an air inlet and air outlet, the projectile inlet and the first tubular pipe portion outlet forming a relatively smooth, curved projectile pathway therebetween; and s a second tubular pipe portion having an air inlet for receiving compressed air and an air outlet extending into the first tubular pipe portion for introducing compressed air thereto;

the first tubular pipe portion outlet for receiving projectiles along the projectile pathway and compressed air from the air inlet, the relatively smooth curved projectile pathway being sized for allowing passage of projectiles therealong from the projectile inlet to the first tubular pipe portion outlet, and said second tubular pipe portion air outlet extending into and beyond the air inlet end of the first tubular pipe portion and the air outlet of the second tubular portion terminating immediately adjacent to and in close proximity to the projectile pathway for introducing said compressed air centrally of and into the projectile pathway for producing air flow into therein without obstructing said projectile pathway;

a muzzle connected to the outlet of the first tubular pipe portion of the venturi and having an inlet for receiving projectiles and a muzzle outlet for firing projectiles therefrom;

a light source positioned within the interior space of the housing between the inlet and the outlet for illuminating the projectiles in the housing to optically excite the projectiles, such that excited projectiles are fired from the muzzle; and a blower coupled to the air inlet of the venturi for moving projectiles therein to the muzzle outlet.

2. The apparatus as claimed in claim 1 wherein the enclosure has reflective surfaces.

3. The apparatus as claimed in claim 1 further including a passageway in the housing comprising at least one of a transparent tubular portion, and a helical section for supporting projectiles relative to the light source from the inlet to the outlet of the enclosure.

4. The apparatus as claimed in claim 1 wherein the venturi comprises a wye formed by the first and second tubular pipe portions.

5. The apparatus as claimed in claim 1 wherein the enclosure comprises a chamber for receiving projectiles therein.

6. The apparatus as claimed in claim 1 including a hopper upstream of the enclosure for supplying projectiles thereto.

7. The apparatus as claimed in claim 1 wherein the air outlet conforms to the projectile pathway and introduces the compressed air centrally of the projectile pathway towards the venturi outlet.

8. An apparatus for optically exciting and firing glowing optically excitable projectiles into an audience space comprising:

a housing having an interior space defined by an outer wall, an inlet and an outlet, and an interior passageway extending between the inlet of the housing and the outlet for carrying projectiles therethrough from the inlet to the outlet;

a light source located proximate to the interior passageway for illuminating the projectiles therein so that the projectiles become optically excited and glow as the projectiles are carried to the outlet;

a venturi having a projectile inlet coupled to the housing outlet for receiving optically excited projectiles, the venturi having an air inlet for receiving compressed air and venturi outlet for excited projectiles and compressed air, said venturi comprising a tubular portion having a curved, relatively smooth pathway extending between the projectile inlet and the venturi outlet for carrying projectiles therethrough and being sized to allow passage of projectiles therethrough along the projectile pathway from the projectile inlet to the venturi outlet, said venturi having a second air inlet intersecting the tubular portion and having a compressed air outlet and extending into and beyond an end of the tubular portion and terminating immediately adjacent to and in close proximity to the projectile pathway for injecting air under pressure therein into the passageway for producing air flow into the projectile pathway towards the venturi outlet for driving the projectiles along the projectile pathway towards the projectile outlet without obstructing the projectiles in the projectile pathway;

a muzzle having an inlet coupled to the venturi outlet for receiving excited projectiles and compressed air and a muzzle outlet for firing projectiles into the audience space; and a blower operatively coupled to the venturi air inlet for producing a stream of compressed air causing the projectiles to move from the outlet of the housing through the venturi to the muzzle outlet as the projectiles are illuminated and excited by the light source, so that, the optically excited projectiles are fired from the muzzle outlet to the audience space.

9. The apparatus of claim 8 wherein the venturi comprises a tubular wye having a curved, relatively smooth projectile pathway therein and a straight portion intersecting the curved pathway for receiving compressed air.

10. The apparatus of claim 9 wherein the air inlet is located centrally of and is sized smaller than the projectile path.

11. The apparatus of claim 8 wherein the outlet end is disposed at an oblique angle relative to the projectile path.

12. The apparatus of claim 8 wherein the air inlet is located centrally of and is sized smaller than the projectile path.

13. The apparatus of claim 12 wherein the air inlet has an outlet end disposed centrally of the projectile path within the curved portion, relative to the projectile path.

14. The apparatus as claimed in claim 8 wherein the passageway comprises at least one of a transparent tubular portion, and a helical section for supporting projectiles relative to the light source from the inlet to the outlet of the housing.

15. The apparatus as claimed in claim 8 wherein the enclosure has reflective surfaces.

* * * * *